United States Patent [19]

Naidu

[11] Patent Number: 4,730,759

[45] Date of Patent: Mar. 15, 1988

[54] BABY CARRIER

[76] Inventor: Yoga Naidu, Bay B-5, 416 Meridian Rd., Calgary, Alberta, Canada, T2A 1X2

[21] Appl. No.: 876,465

[22] Filed: Jun. 20, 1986

[51] Int. Cl.[4] ..... A61G 1/00

[52] U.S. Cl. ..... 224/158; 2/69.5; 5/98 R; 294/140

[58] Field of Search ..... 224/155, 156, 158, 159, 224/160; 5/93 R, 98 R, 98 B, 434; 294/140; 2/69.5

[56] References Cited

U.S. PATENT DOCUMENTS

| | | | |
|---|---|---|---|
| 2,231,108 | 2/1941 | Brady | 5/93 R |
| 2,253,024 | 8/1941 | Farrand | 5/98 R |
| 2,551,509 | 5/1951 | Smith | 294/140 |
| 2,628,358 | 2/1953 | Neils | 224/158 X |
| 3,096,917 | 7/1963 | Gudiksen | 5/98 R |
| 4,536,905 | 8/1985 | DeSantis | 5/434 |

FOREIGN PATENT DOCUMENTS

| | | | |
|---|---|---|---|
| 0144648 | 10/1980 | Fed. Rep. of Germany | 224/158 |
| 2507957 | 6/1981 | France | 5/93 R |

*Primary Examiner*—Henry J. Recla
*Assistant Examiner*—David Voorhees
*Attorney, Agent, or Firm*—Stanley G. Ade; Adrian D. Battison; Murray E. Thrift

[57] ABSTRACT

A rectangular base has a rigid board supporting a removable mattress pad. Sides and ends consist of non-allergenic foam between two panels of a polyester and cotton material. Side handles are situated on the side at approximately the center of gravity of the carrier and a padded or cloth cover is attached around the major portion of the upper ends of the sides and one end of the carrier. A padded hood is detachably secured on the other end of the carrier by snap fasteners and this hood can be removed and stored around said other end and the underside of the carrier and may be secured by the same snap fasteners.

17 Claims, 6 Drawing Figures

BABY CARRIER

BACKGROUND OF THE INVENTION

This invention relates to new and useful improvements in carriers for babies or small children and in specifically designed as a portable means of transporting an infant child in comfort and safety and it may also be used as an alternative, as a portable crib.

It is particularly suited for long distance air flights, outdoors, and all transportation except when in an automobile.

Conventionally, such carriers are usually made of soft material and are not insulated so that additional clothing has to be utilized in order to ensure that the occupant remains warm at all times.

Also, such carriers are sometimes difficult to carry and consist of rigid sides and a hood portion which is difficult to raise or lower or to store when not required.

The present invention overcomes these disadvantages and one aspect of the invention consists of a carrier for babies or small children comprising in combination a base, a pair of spaced apart longitudinally extending, parallel side panels extending upwardly from said base and a pair of transverse end panels extending upwardly from said base and extending between the respective ends of said side panels, a stiffening board in said base and a detachable mattress pad on said board, a cover detachably secured along the major the portion of said side panels and around one end panel on the upper edges thereof, a looped carrying handle on each side panel spanning the centre of gravity of said carrier and a detachable hood for said carrier, means on said side panels and said other end panel of said carrier to detachably and selectively receive said hood in either of two positions, namely, in a raised position extending the above the minor portion of said side panels and said other end panel of said carrier or in a stored position engaged around the minor portion of said side panels and said end panel and a part of the underside of said base.

Another advantage of the invention is that the hood is readily stored below the end of the carrier when not in use.

Another advantage of the invention is that the cover is easily removed and reversed if required, or, alternatively the padded cover can be exchanged for a relatively light weight cover when the ambience temperature is relatively high.

A still further advantage of the invention is to provide a device of the character herewithin described which is simple in construction, economical to manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typcial embodiment of the principles of the present invention, in which:

DESCRIPTION OF THE DRAWINGS

In the drawings like characters of reference indicate corresponding parts in the different figures.

DETAILED DESCRIPTION

Figure 1:
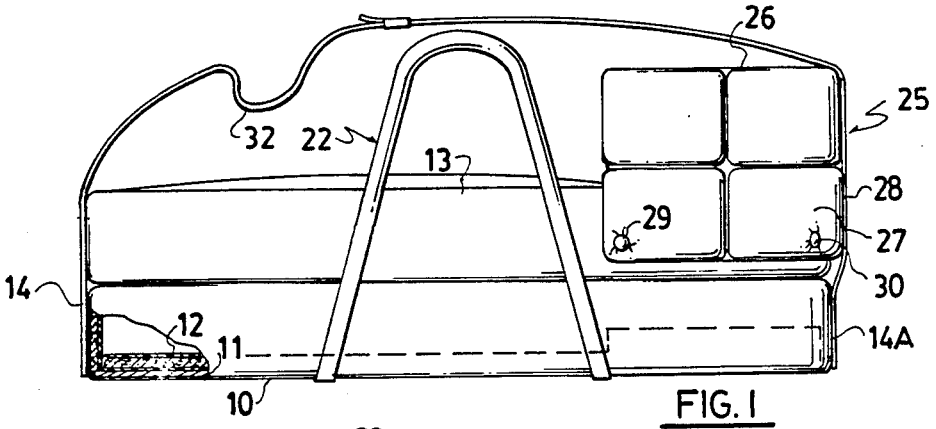
FIG. 1 is a side elevation of the carrier with the hood in the erected or raised position.

Proceeding therefore to describe the invention in detail, reference character 10 illustrates the rectangular fabric base of the carrier having a relatively stiff board 11 engaged therein to give rigidity to the base.

A mattress pad of foam 12 rests upon the board and it is preferable that the foam be non-allergenic and covered with a plastic case to prevent seepage of liquids into the foam. Over this plastic case may be provided a sleeve-type cover of a flannelette type of material or the like which can be removed for washing.

A pair of spaced and parallel longitudinally extending sides 13 extend upwardly from the longitudinal edges of the base and a pair of ends 14 also extend upwardly from the base and extend betewen the corresponding ends of the sides 13. The junction of the sides and ends, to the base may be reinforced by stitched binding (not illustrated) at the seam.

Both the sides 13 and the ends 14 are made preferably from a pair of flexible panels of cotton and polyester blend enclosing padding in the form of nonallergenic foam 15, the outer and inner side panels being indicated by reference character 16 and 17 respectively. These may be stitched to the foam or otherwise secured in a conventional manner or, alternatively, may be quilted together.

An elongated plastic slide fastener 18 extends from the upper edge of one side from a point 19, along the major portion of this side and around the end 14 and then along the major portion of the other side terminating at a point 20 diametrically opposite to the point 19.

Figure 2:
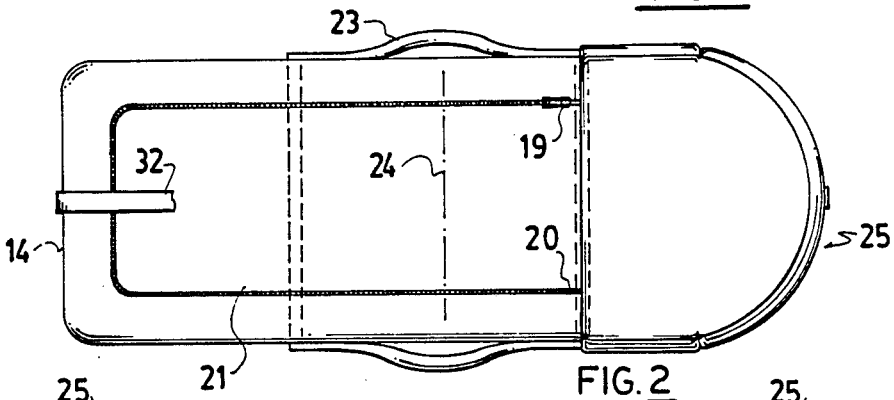
FIG. 2 is a top plan view of FIG. 1.
Figure 3:
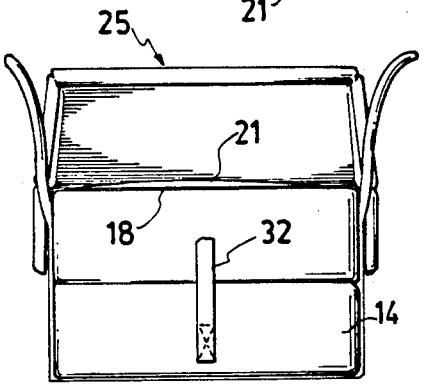
FIG. 3 is an end view taken from the righthand end of FIG. 1.
Figure 4:
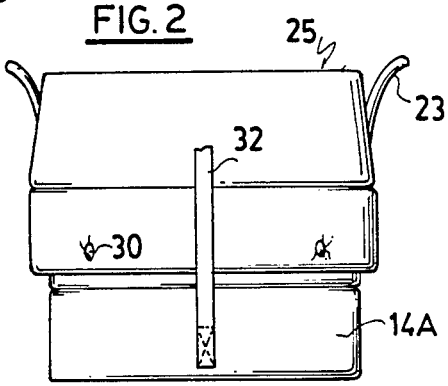
FIG. 4 is an end view taken from the lefthand end of FIG. 1.

This detachably secures a substantially rectangular cover 21, in position as indicated in FIG. 2. This cover is reversible and may be provided in two forms. Firstly, a cover of relatively thin material usable perhaps in the summer months and secondly a padded cover consisting of a construction similar to that shown in FIG. 6 thus providing a padded construction with insulating value, for cold weather.

A handle assembly collectively designated 22 consists of an elongated endless length of foam covered by a synthetic plastic webbing in which the major portion extends transversely under the base 10 of the carrier and is secured thereto. The two closed loop ends 23 may then extend upwardly parallel to each side panel 13 and can be grasped either by two people with the carrier between them or by one person with the handles meeting substantially along the longitudinal axis of the carrier.

These handles are situated in a position whereby they span the approximate centre of gravity of the carrier indicated by the transverse line 24.

A hood is provided collectively designated 25 consisting of an upper panel 26, side panels 27 and one end panel 28.

It is detachably secured by snap fasteners 29 and 30, to the minor portions of the sides 13 behind the points 19 and 20 and around the rear end 14A of the carrier.

Figure 6:
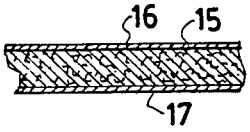
FIG. 6 is a fragmentary enlarged cross sectional view showing the construction of the walls and hood of the carrier.

The hood is manufactured from a material similar to that shown in FIG. 6 thus giving it sufficient body to remain in the erected position when attached as shown in FIG. 1.

Figure 5:
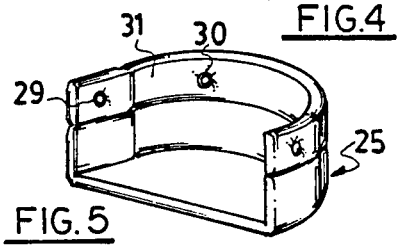
FIG. 5 is an isometric view of the hood per se in position to be fitted to the carrier in the stored position.

However, it may be removed and stored when not required and FIG. 5 shows one method of storing the hood.

It is turned inside out and the free edges 30 are turned downwardly as clearly shown in FIG. 5 with the open portion of the hood facing upwardly.

It is then engaged around the rear of the carrier with the snap fasteners engaging the corresponding portions thereof on the sides and rear of the carrier.

Finally a shoulder engaging carrier strip 32 extends between the two ends and over the carrier and is adjustable so that, if desired, the carrier can be supported over the shoulder of the person transporting the carrier.

Also to be noted but not illustrated is the fact that a miniature carrier can be produced which fits inside the main carrier and can be used for a doll.

I claim:

1. A carrier for babies or small children comprising in combination a base, a pair of spaced apart longitudinally extending, parallel side panels extending upwardly from said base and a part of transverse end panels extending upwardly from said base and extending between respective ends of said side panels, a stiffening board in said base and a detachable mattress pad on said board, a cover detachably secured along a major portion of each said side panel and around one end panel on upper edges thereof, a looped carrying handle on each side panel spanning the center of gravity of said carrier and a detachable hood for said carrier, means on said side panels and the other end panel of said carrier to detachably and selectively receive said hood in either of two positions, namely, in a raised position extending above a minor portion of each of said side panels and said other end panel of said carrier or in a stored position engaged around the minor portion of each of said side panels and said other end panel and a part of the underside of said base.

2. The carrier according to claim 1 in which said means upon said side panels and said other end panel to detachably receive said hood includes a plurality of snap fasteners with portions thereof on said hood and portions thereof on said panels, cooperating between said hood and said side panels and said other end panel when in said erected position to maintain said hood in the raised position, the hood comprising an upper panel, two sides and an end, with the sides and the end depending from respective edges of the upper panel free edges of said sides and said end being folded inwardly when in said stored position whereby said snap fastener positions on said hood cooperate with said corresponding portions on said panel when in the stored position.

3. The carrier according to claim 1 in which said side and end panels include outer and inner fabric cover sheets and a non-allergenic layer of foam secured therebetween.

4. The carrier according to claim 2 in which said side and end panels include outer and inner fabric cover sheets and a non-allergenic layer of foam secured therebetween.

5. The carrier according to claim 1 in which said hood includes outer and inner fabric sheets and a non-allergenic layer of foam secured therebetween.

6. The carrier according to claim 2 in which said hood includes outer and inner fabric sheets and a non-allergenic layer of foam secured therebetween.

7. The carrier according to claim 3 in which said hood includes outer and inner fabric sheets and a non-allergenic layer of foam secured therebetween.

8. The carrier according to claim 4 in which said hood includes outer and inner fabric sheets and a non-allergenic layer of foam secured therebetween.

9. The carrier according to claim 1 in which said looped carrying handles on each side panel of said carrier are in the form of a one-piece sling extending under said carrier and being secured to said base and extending upwardly along each said panel and above the upper edges thereof in the form of a closed loop on each side substantially parallel to the side panels.

10. The carrier according to claim 2 in which said looped carrying handles on each side panel of said carrier are in the form of a one-piece sling extending under said carrier and being secured to said base and extending upwardly along each side panel and above the upper edges thereof in the form of a closed loop on each side lying substantially parallel to the side panels.

11. The carrier according to claim 3 in which said looped carrying handles on each side panel of said carrier are in the form of a one-piece sling extending under said carrier and being secured to said base and extending upwardly along each side panel and above the upper edges thereof in the form of a closed loop on each side lying substantially parallel to the side panels.

12. The carrier according to claim 1 which includes an adjustable shoulder-engaging carrier strap extending from adjacent the centre of one of said end panels over said carrier, to adjacent the centre of the other of said end panels.

13. The carrier according to claim 2 which includes an adjustable shoulder-engaging carrier strap extending from adjacent the centre of one of said end panels over said carrier, to adjacent the centre of the other of said end panels.

14. The carrier according to claim 3 which includes an adjustable shoulder-engaging carrier strap extending from adjacent the centre of one of said end panels over said carrier, to adjacent the centre of the other of said end panels.

15. The carrier according to claim 1 in which said cover is reversible upon said carrier.

16. The carrier according to claim 2 in which said cover is reversible upon said carrier.

17. The carrier according to claim 3 in which said cover is reversible upon said carrier.

* * * * *